United States Patent [19]

Heilman

[11] 4,260,124

[45] Apr. 7, 1981

[54] EASEL

[76] Inventor: Gregory S. Heilman, 2035 Kinsley, Santa Cruz, Calif. 95060

[21] Appl. No.: 53,022

[22] Filed: Jun. 28, 1979

Related U.S. Application Data

[63] Continuation of Ser. No. 893,012, Apr. 3, 1978, abandoned.

[51] Int. Cl.[3] ..... A47B 47/08

[52] U.S. Cl. ..... 248/449; 248/460; 403/94; 403/346

[58] Field of Search ..... 248/448, 449, 460, 463, 248/464, 465; 403/94, 101, 327, 339, 340, 346

[56] References Cited

U.S. PATENT DOCUMENTS

| | | | |
|---|---|---|---|
| 1,218,790 | 3/1917 | McCarthy | 248/464 |
| 3,396,933 | 8/1968 | Ward | 403/346 |
| 3,927,950 | 12/1975 | Herrman et al. | 403/346 |

FOREIGN PATENT DOCUMENTS

| | | | |
|---|---|---|---|
| 88813 | 12/1921 | Austria | 403/346 |
| 171972 | 2/1906 | Fed. Rep. of Germany | 248/463 |
| 836745 | 1/1939 | France | 248/465 |
| 1338 | 12/1984 | Italy | 248/465 |
| 444808 | 2/1968 | Switzerland | 248/465 |

*Primary Examiner*—William H. Schultz
*Attorney, Agent, or Firm*—Robert G. Slick

[57] ABSTRACT

A folding easel is provided wherein the two uprights of the easel are provided with complementary mortises or notches which hold the two uprights together at a fixed angle when the two uprights are held together with a clamp. The clamp means can be released, allowing the two uprights to be held in a parallel relationship for transportation or storage.

1 Claim, 4 Drawing Figures

EASEL

This is a continuation of application Ser. No. 893,012 filed Apr. 3, 1978, now abandoned.

SUMMARY OF THE INVENTION

The present invention relates to a highly stable portable easel.

In the past, most artist's easel have been heavy studio structures which could not readily be moved.

Artists frequently desire a portable easel which can be moved to a desired scene as, for example, when painting a landscape.

The difficulty with portable easels in the past has been that they lack the stability of a studio easel so that they are difficult to work with. The unstable easel vibrates and moves when it is touched by the artist and is also susceptible to movement by wind.

In accordance with the present invention, a light weight easel is provided which is extremely stable, yet which can be moved readily to a desired location. Thus, the easel of the present invention combines the stability of the usual heavy studio easel with the ready portability of a traveling easel.

Various other features and advantages of the invention will be brought out in the balance of the specification.

DESCRIPTION OF THE PREFERRED EMBODIMENTS

Figure 1:
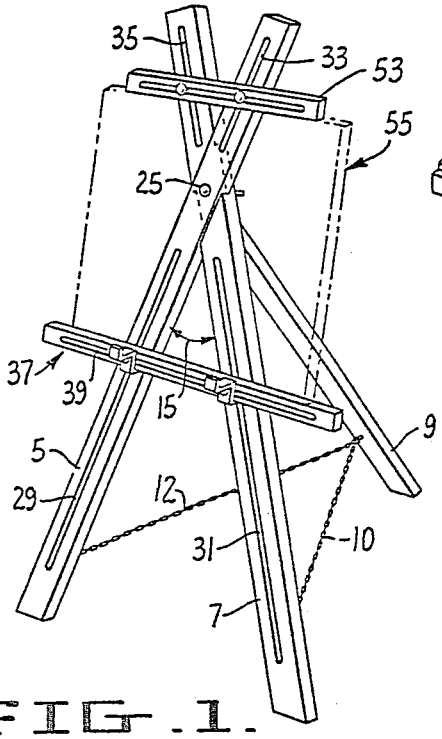
FIG. 1 is a perspective view of an easel embodying the present invention.
Figure 4:
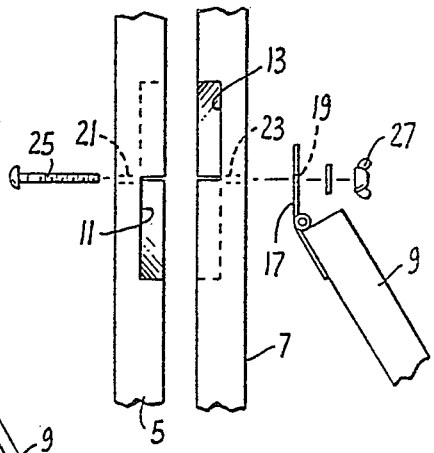
FIG. 4 is an enlarged view on the line 4—4 of FIG. 3.

Referring now to the drawings by reference characters, the easel of the present invention comprises three main parts, namely, uprights 5 and 7 and a leg 9. The uprights 5 and 7 have mortises or notches which are complementary to each other, namely, the mortise 11 in upright 5 and the mortise 13 in upright 7. These mortises extend about half-way through the uprights, as is best seen in FIG. 4, so that when the uprights are placed together with the mortises mating, the outer surfaces of the two uprights are substantially flush with each other. The angles of the mortises 11 and 13 are such that when the two uprights are placed together as is shown in FIG. 1, the angle 15 between them is roughly 45°.

The upper portion of the leg 9 is provided with a hinge or other suitable connector 17 and the upper portion of the hinge has a hole 19 while the uprights 5 and 7 have corresponding holes 21 and 23 in the center of each mortise. A bolt 25 can now be passed through the holes 19, 21 and 23 and held in place with a wing nut 27 to hold the parts together.

The uprights 5 and 7 have lower slots 29 and 31, respectively, and upper slots 33 and 35. The cross member 37 which has a slot 39 is bolted by means of bolts 43 and 45 through the clips 47 and 49 to the lower slots 29 and 31, as is best seen in FIG. 1, greatly strengthening the easel. Cross member 53 may be bolted to the upper slots 33 and 35 to hold a picture or the like 55 which is shown in phantom.

Chains 10 and 12 connected between the leg 9 and the uprights 5 and 7 stabilized the assembly.

Figure 2:
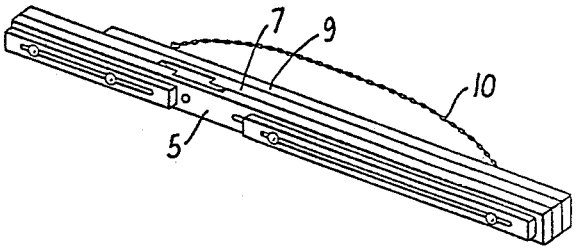
FIG. 2 is a perspective view of the easel shown in FIG. 1 in knock-down condition for transportation.
Figure 3:
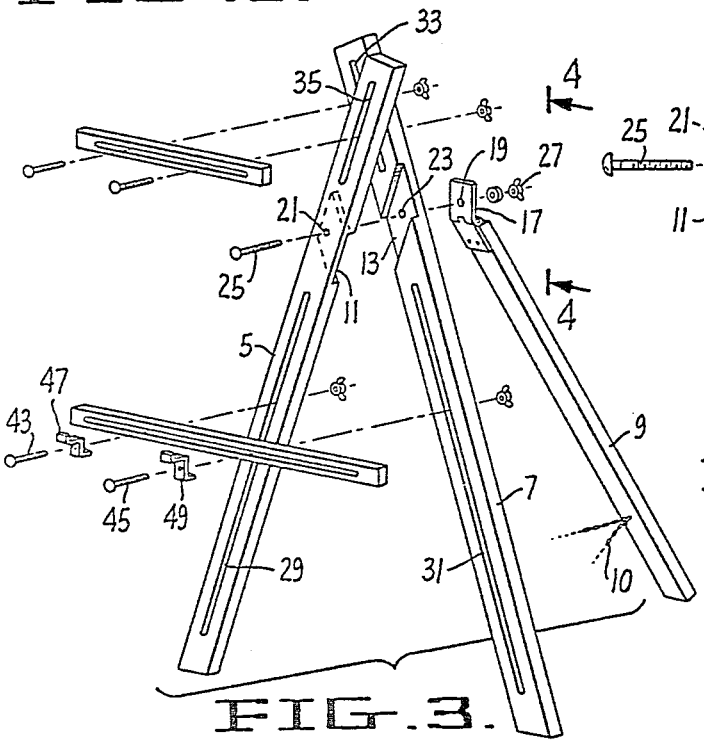
FIG. 3 is an exploded view of the easel.

It will be apparent when the structure is assembled, as is shown in FIG. 1, that it is extremely strong and substantially vibration-proof. However, it is light in weight and can be easily disassembled by removing the bolts holding the cross members and by loosening the bolt 26 so that the uprights and leg can be brought into side-by-side relationship as is shown in FIG. 2. Chains 10 or 12 can now be connected to the upper end of the uprights so that the easel can be easily carried.

It is believed apparent from the foregoing that I have provided an easel which is simple in construction, easy to disassemble and to carry, yet one which is very rugged when it is set up and substantially free from vibration.

I claim:

1. A folding easel comprising in combination:

(a) first and second uprights, each upright being formed with an elongate slot extending a substantial distance along the length of said uprights;

(b) a mortise in each of said uprights, said mortises being complementary and adapted to hold the two uprights crossed relative to each other and at an acute angle relative to each other;

(c) releasable clamp means at the middle of said mortises adapted to hold the two uprights together at the angle dictated by the mortises in a first position and permitting the two uprights to lie side by side in a parallel relationship in a carrying position of longitudinal alignment when said clamping means is removed;

(d) a leg member attached to said clamping means to hold the easel upright when the uprights are in said first position;

(e) a horizontal cross member adapted to be connected to said uprights below said clamping means, said cross member being formed with an elongate slot extending a substantial distance along the length thereof, the lengths of the slot formed in said cross member overlapping the slots formed in said uprights for various horizontal positions of adjustment, (f) and means projecting through the slot of said cross member and slots of said uprights for securing said member to said uprights in various positions of horizontal adjustment and said carrying position of longitudinal alignment.

* * * * *